US009915257B2

(12) United States Patent
Garrett et al.

(10) Patent No.: US 9,915,257 B2
(45) Date of Patent: Mar. 13, 2018

(54) DEVIATION TOLERANT WELL PLUNGER PUMP

(71) Applicant: Baker Hughes Incorporated, Houston, TX (US)

(72) Inventors: David Garrett, Bartlesville, OK (US); Shawn N. Gunter, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 490 days.

(21) Appl. No.: 14/541,322

(22) Filed: Nov. 14, 2014

(65) Prior Publication Data

US 2015/0136418 A1 May 21, 2015

Related U.S. Application Data

(60) Provisional application No. 61/906,657, filed on Nov. 20, 2013.

(51) Int. Cl.

| | |
|---|---|
| ***F04B 47/04*** | (2006.01) |
| ***F04B 9/117*** | (2006.01) |
| ***E21B 43/12*** | (2006.01) |

(52) U.S. Cl.

CPC ..... *F04B 47/04* (2013.01); *E21B 43/127* (2013.01); *F04B 9/117* (2013.01)

(58) Field of Classification Search

CPC ..... E21B 43/00; E21B 43/127; F04B 9/117; F04B 47/12; F04B 47/14; F04B 2015/026; F04B 47/02; F04B 47/04; F04B 47/06; F04B 47/08

USPC ..... 417/555.5, 385, 387

See application file for complete search history.

(56) References Cited

U.S. PATENT DOCUMENTS

| | | | | |
|---|---|---|---|---|
| 3,420,183 | A * | 1/1969 | Hart | F04B 9/1053 166/105.1 |
| 5,163,515 | A | 11/1992 | Tailby et al. | |
| 7,849,935 | B2 | 12/2010 | Johnson et al. | |
| 8,528,648 | B2 * | 9/2013 | Zupanick | E21B 33/128 166/263 |
| 2011/0214880 | A1 * | 9/2011 | Rogers | E21B 43/00 166/372 |

FOREIGN PATENT DOCUMENTS

| | | |
|---|---|---|
| CN | 2708002 Y | 7/2005 |
| CN | 2934658 Y | 8/2007 |

* cited by examiner

*Primary Examiner* — Taras P Bemko
*Assistant Examiner* — Manuel C Portocarrero
(74) *Attorney, Agent, or Firm* — Bracewell LLP; James E. Bradley

(57) ABSTRACT

A well pump assembly has an upper plunger and a lower plunger. A working fluid conduit extends between the upper and lower plunger. An upper piston in the working fluid conduit is connected with the upper plunger. A lower piston in the working fluid conduit is connected with the lower plunger. A downstroke working fluid is located between the upper and lower pistons in the working fluid conduit. An upstroke conduit extends between an upper port in the working fluid conduit above the upper piston and a lower port in working fluid conduit below the lower piston. An upstroke working fluid fills the upstroke conduit and the working fluid conduit above the upper piston and below the lower piston.

17 Claims, 4 Drawing Sheets

DEVIATION TOLERANT WELL PLUNGER PUMP

CROSS REFERENCE TO RELATED APPLICATION

This application claims priority to provisional application Ser. No. 61/906,657, filed Nov. 20, 2013.

FIELD OF THE DISCLOSURE

This disclosure relates in general to oil well pumps and in particular to a pump assembly having an upper reciprocating, rod driven pump within a vertical portion of a well that remotely drives a lower reciprocating pump in an inclined portion of the well.

BACKGROUND

Many oil wells employ a rod pump for pumping well fluid to the surface. A string of sucker rods extends from a pump jack at the upper end of the well to a reciprocating pump located in the well below the well fluid level. The pump jack strokes the rods and thus the pump upward and downward to lift well fluid to the wellhead.

Some wells have a vertical upper portion that curves into an inclined lower section that may even be horizontal. Placing the pump in the inclined lower section is a problem because the rod string would have to bend through the bend in the well casing and tubing. As the rod string moves up and down in the well, wear occurs on the rod string and well as the tubing in which it extends.

SUMMARY

A well pump assembly is disclosed for pumping well fluid from a well having an upper vertical section and a lower inclined section. An upper lifting unit has an upper plunger configured for upward and downward movement within the upper vertical section of the well to pump well fluid up the well. A lower lifting unit has a lower plunger configured for upward and downward movement within the lower inclined section of the well to pump well fluid up to the upper lifting unit. A linking means causes the lower plunger to move upward in response to the upward movement of the upper plunger, and to move downward in response to the downward movement of the upper plunger.

In the embodiment shown, the linking means includes a working fluid conduit extending between the upper and the lower lifting units. An upper piston in the working fluid conduit is connected with the upper plunger for upward and downward movement in unison. A lower piston in the working fluid conduit is connected with the lower plunger, the lower plunger being movable in unison with the lower piston. A downstroke working fluid fills the working fluid conduit between the upper and lower pistons. Downward movement of the upper piston transmits a downward force through the working fluid to the lower piston, causing the lower piston to move downward.

Preferably, the downstroke working fluid is a liquid trapped in the working fluid conduit between the upper piston and the lower piston. The working fluid defines a fixed distance between the upper piston and the lower piston. The downstroke working liquid is sealed from the well fluid in the string of tubing in the preferred embodiment.

The linking means may also include an upstroke conduit extending between the upper and lower lifting units and containing an upstroke working fluid. The upper piston is in contact with the upstroke working fluid for applying an increased pressure to the upstroke working fluid while the upper piston is moving upward. The lower piston is in contact with the upstroke working fluid, such that the increased pressure applied to the upstroke working fluid by the upper piston moves the lower piston upward in response.

In the embodiment shown, the upstroke conduit is sealed from well fluid in the vertical and inclined portions of the tubing. The upstroke working fluid is also located in the working fluid conduit above the upper piston and below the lower piston. The upstroke working fluid is sealed from the downstroke working fluid by the upper piston and by the lower piston.

In the example shown, the upstroke conduit surrounds the working fluid conduit, defining an inner annulus between the upstroke conduit and the working fluid conduit. An upper communication port extends from the upstroke conduit into the working fluid conduit above the upper piston. A lower communication port extends from the upstroke conduit into the working fluid conduit below the lower lifting unit piston. The upstroke working fluid is located in the inner annulus, in the working fluid conduit above the upper piston, and in the working fluid conduit below the lower piston. Upward movement of the upper piston exerts a force on the upstroke working fluid within the working fluid conduit above the upper piston that transmits via the inner annulus to the upstroke working fluid below the lower piston, causing the lower lifting unit piston to move upward in response.

In the embodiment shown, a lower section of production tubing extends between the upper and lower lifting units and surrounds the upstroke conduit, defining an outer annulus. The outer annulus communicates well fluid being pumped upward by the lower plunger to the upper lifting unit.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
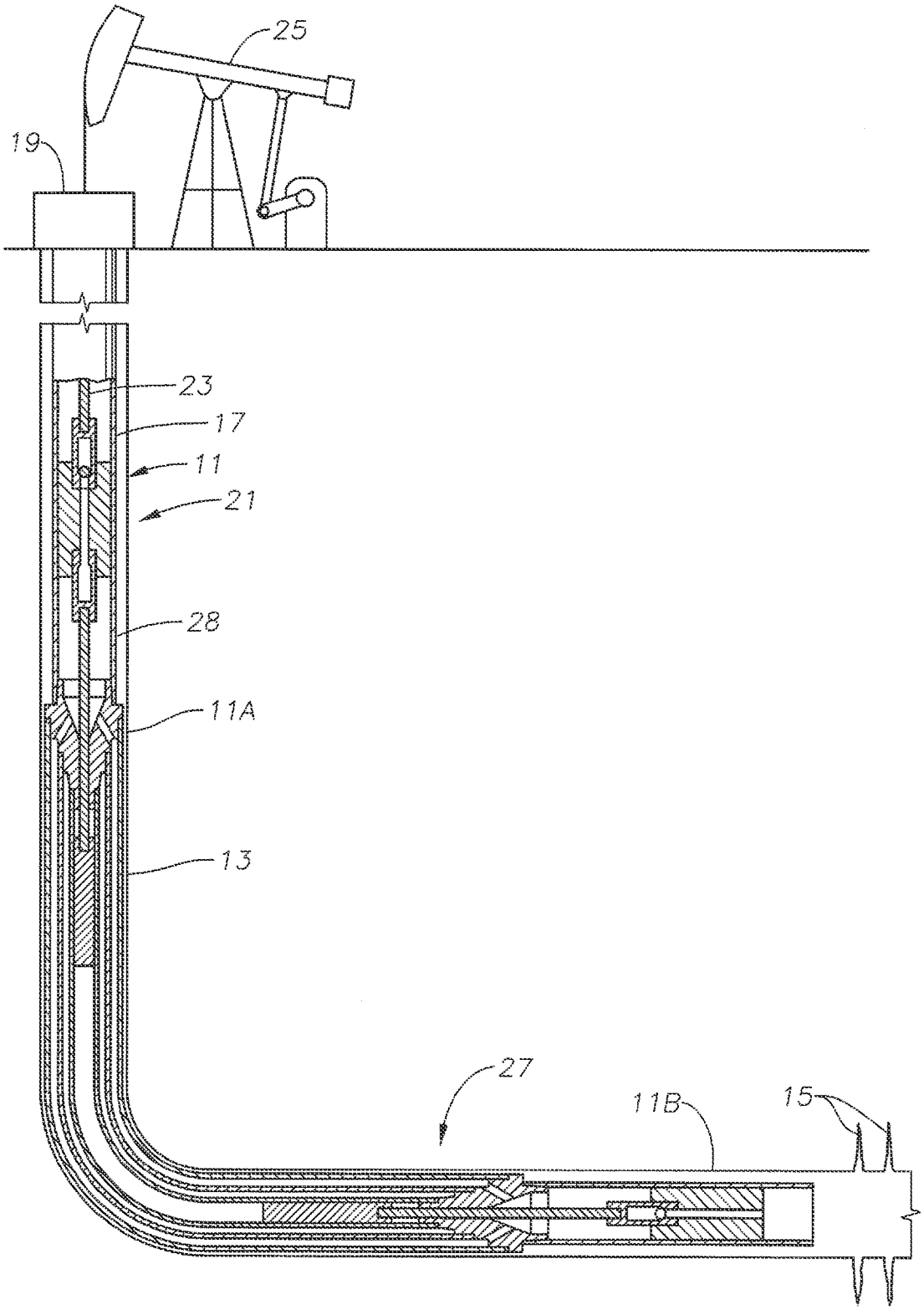
FIG. 1 is a side view of a well pump assembly in accordance with this disclosure and installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, well 11 has a substantially vertical upper section 11A and an inclined lower section 11B that is illustrated as being horizontal. A bend section connects vertical section 11A with inclined section 11B. Well 11 is cased with a string of casing 13 that extends through vertical section 11A and inclined section 11B. Inclined section 11B has openings to the earth formation to admit well fluid, the openings being schematically illustrated as perforations 15. A production tubing string 17 is supported at a wellhead 19 and an upper portion is located in vertical section 11A.

An upper pump subassembly or upper lifting unit 21 in well vertical section 11A secures to a lower end of tubing string 17. A string of sucker rods 23 extends down from wellhead 19 through tubing string 17 and operatively connects to upper pump subassembly 21. A conventional rod stroking mechanism 25, such a pump jack, hydraulic lifting mechanism or like, is located adjacent to wellhead 19 and strokes sucker rod string 23 up and down.

Inclined well section 11B contains a lower pump subassembly or lower lifting unit 27, which may be thousands of feet from upper pump subassembly 21. Sucker rod string 23 does not extend from upper pump subassembly 21 to lower pump subassembly 27. If it did, wear on the sucker rods and tubing in the bend section between vertical section 11A and inclined section 11B would occur. The following explanations disclose means other than sucker rods for stroking portions of lower pump subassembly 27 in response to the reciprocating movement of portions of upper pump subassembly 21.

Figure 2A:
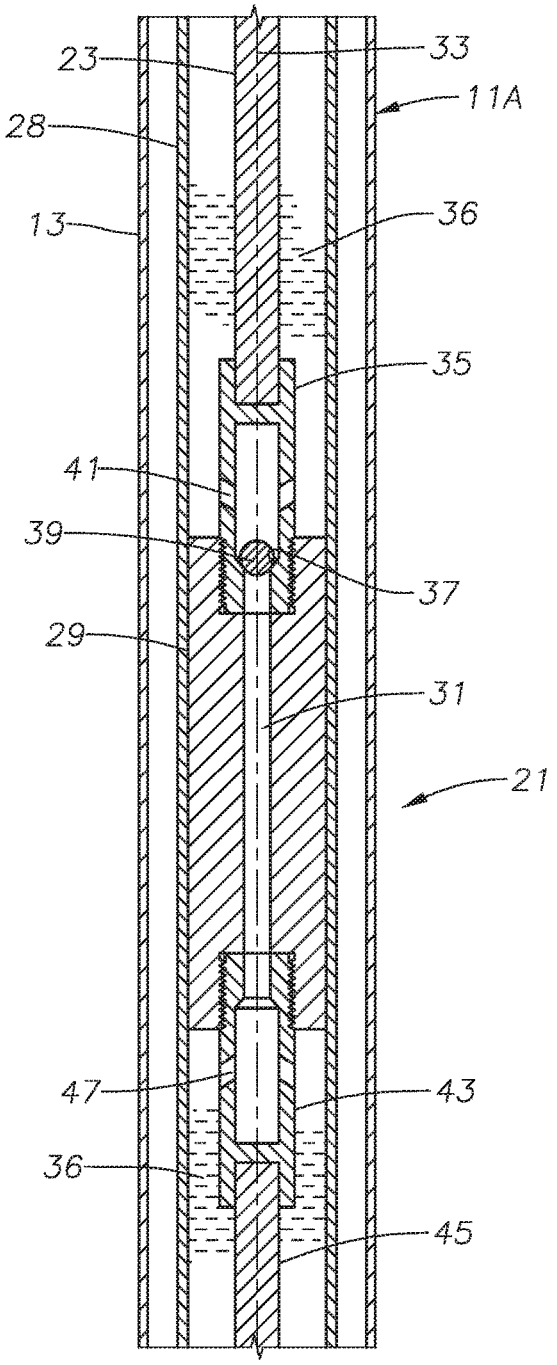
FIGS. 2A and 2B are a sectional view of the upper portion of the pump assembly of FIG. 1.

Referring to FIG. 2A, upper pump subassembly 21 has a tubular upper pump housing or upper barrel 28 that secures to the lower end of the upper portion of tubing string 17 and may be considered to be a part of tubing suing 17. Upper pump subassembly 21 has an upper plunger 29 sealingly engages a polished bore section of upper pump housing 28. Upper plunger 29 may be constructed of metal, metal and elastomer, composites, or other suitable materials. Upper plunger 29 may have a central passage 31 extending along an axis 33 of upper pump subassembly 21. A coupling 35 connects upper plunger 29 to sucker rod string 23 for stroking movement therewith. A valve arrangement causes stroking movement of upper plunger 29 to pump well fluid 36 up upper pump housing 28. The valve arrangement may vary. In this example, coupling 35 has an upward facing hall seat 37 that receives a movable ball 39. Coupling 35 is hollow and has upper ports 41 to cause well fluid 36 in plunger passage 31 to flow through ball seat 37 into upper pump housing 28 when upper plunger 29 is moving downward. Upward movement of upper plunger 29 causes ball 39 to close ball seat 37 and lift well fluid 36 while upper plunger 29 moves upward.

A coupling 43 secures to a lower end of upper plunger 29. The upper end of an upper connecting rod 45 secures to coupling 43. Coupling 43 is hollow and has ports 47 to admit well fluid 36 into the lower end of upper lifting unit passage 31 when upper plunger 29 is moving downward. Upper connecting rod 45 strokes in unison with upper plunger 29.

Figure 2B:
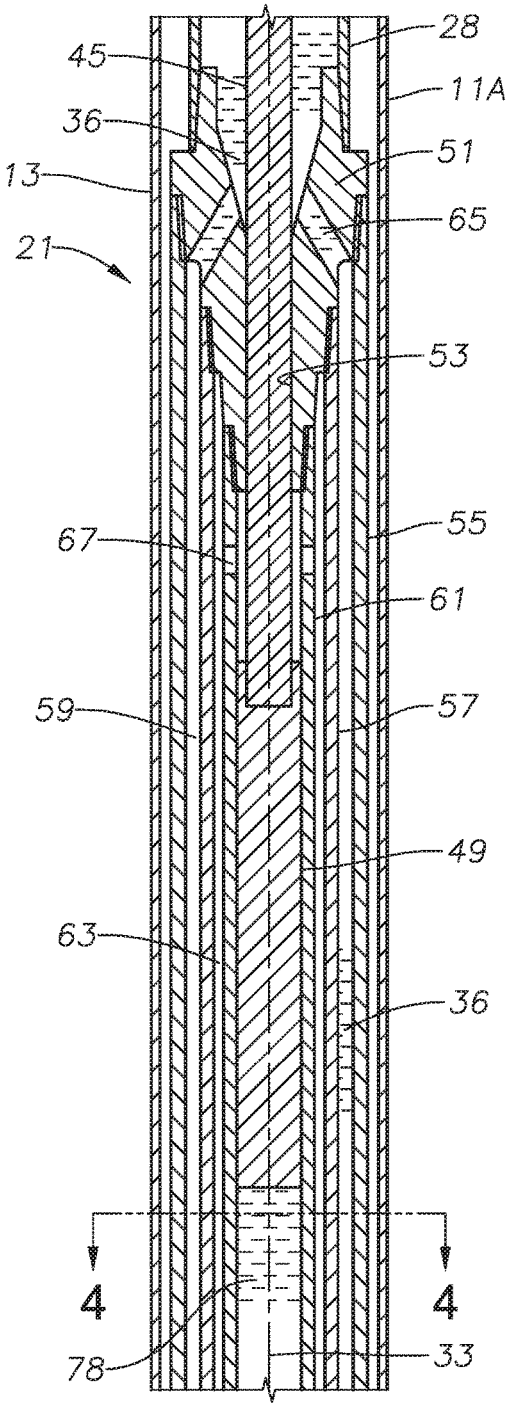

Referring to FIG. 2B, an upper piston 49 secures to the lower end of upper connecting rod 45, which may vary in length, such as between about 5 and 25 feet. The lower end of upper pump housing 28 secures to an upper hanger 51. Upper piston 49 strokes in unison with upper plunger 29 (FIG. 2A) as upper connecting rod 45 sealingly moves within a bore 53 of upper hanger 51.

An outer conduit or tubing 55 has an upper end secured to upper hanger 51. Outer tubing 55 may be considered to be a lower section of production tubing 17 even though outer tubing 55 has a slightly larger diameter than the upper section of production tubing 17 in this example. Outer tubing 55 is illustrated as being larger in diameter than upper pump housing 28, which may have the same diameter as the upper section of production tubing 17. An intermediate tubing, also referred to as an upstroke conduit 57, is concentrically located within outer tubing 55 and has an upper end also secured to upper hanger 51. Upstroke conduit 57 is smaller in outer diameter than the inner diameter of outer tubing 55, defining an outer annulus 59 between upstroke conduit 57 and outer tubing 55. Outer tubing 55 and upstroke conduit 57 may be sized to provide approximately the same flow area as the flow area in upper pump housing 28 surrounding sucker rod string 23 (FIG. 2A).

Figure 4:
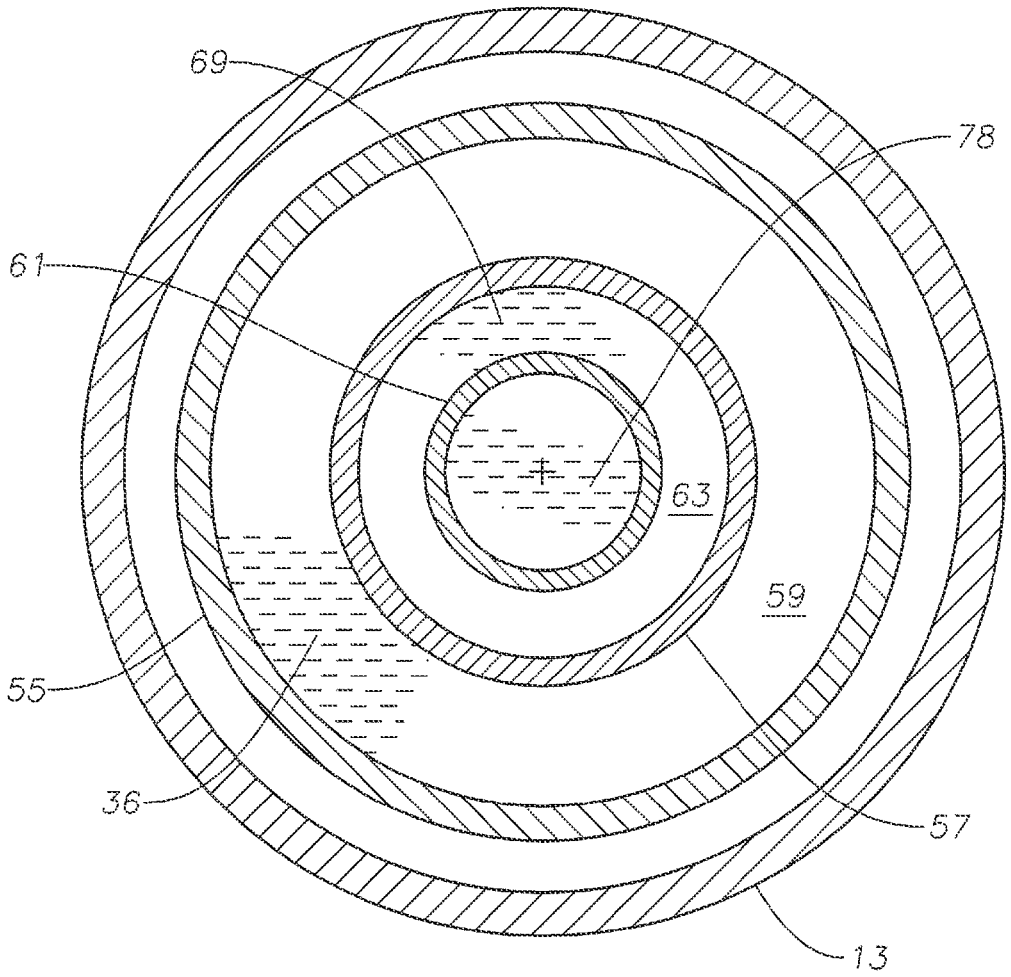
FIG. 4 is a sectional view of the pump assembly of FIG. 1, taken along the line 4-4 of FIG. 2B.

An inner tubing or working fluid conduit 61 within upstroke conduit 57 also has its upper end connected to upper hanger 51. Working fluid conduit 61 has a smaller outer diameter than the inner diameter of upstroke conduit 57, defining an inner annulus 63. FIG. 4 illustrates a cross-sectional view of outer tubing 55, upstroke conduit 57 and working fluid conduit 61.

Referring again to FIG. 2B, upper hanger 51 has ports 65 that communicate well fluid 36 in outer annulus 59 with the interior of upper pump housing 28. Working fluid conduit 61 has upper communication ports 67 near upper hanger 51 that communicate an upstroke working fluid 69 (FIG. 4) above upper piston 49 in working fluid conduit 61 with inner annulus 63. Upper piston 49 moves upward with the lifting of sucker rod string 23 (FIG. 2A), pushing upstroke working fluid 69 above it in working fluid conduit 61 out upper ports 67 into inner annulus 63. Upper piston 49 moves downward with the downward movement of sucker rod string 23, drawing upstroke working fluid 69 from inner annulus 63 through upper ports 67 into working fluid conduit 61 above upper piston 49.

Outer tubing 55, upstroke conduit 57 and working fluid conduit 61 extend from well vertical section 11A around the bend into well inclined section 11B, thus may be up to thousands of feet in length. Outer tubing 55, upstroke conduit 57 and working fluid conduit 61 may be made up of joints of pipe having threaded ends secured together.

When referring to FIGS. 3A and 3B, for convenience only, the terms "lower", "upper", "below" and "above" may be used in the description of lower pump subassembly 27; however, if well section 11B is inclined or horizontal, as shown, the terms "lower"; "downward" and the like refer to the direction toward perforations 15, and not a lower elevation. The terms "upper", "upward" and the like refer to a direction away from perforations 15.

Figure 3A:
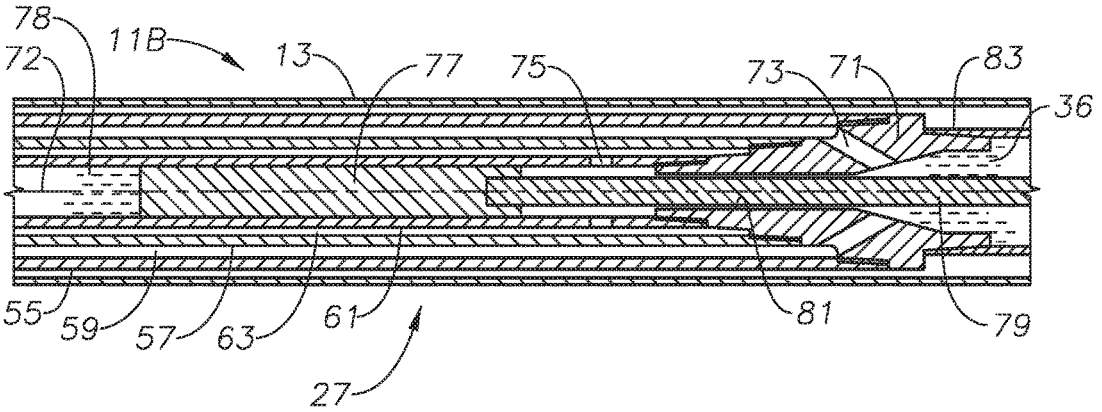
FIGS. 3A and 3B are a sectional view of the lower portion of the pump assembly of FIG. 1.
Figure 3B:
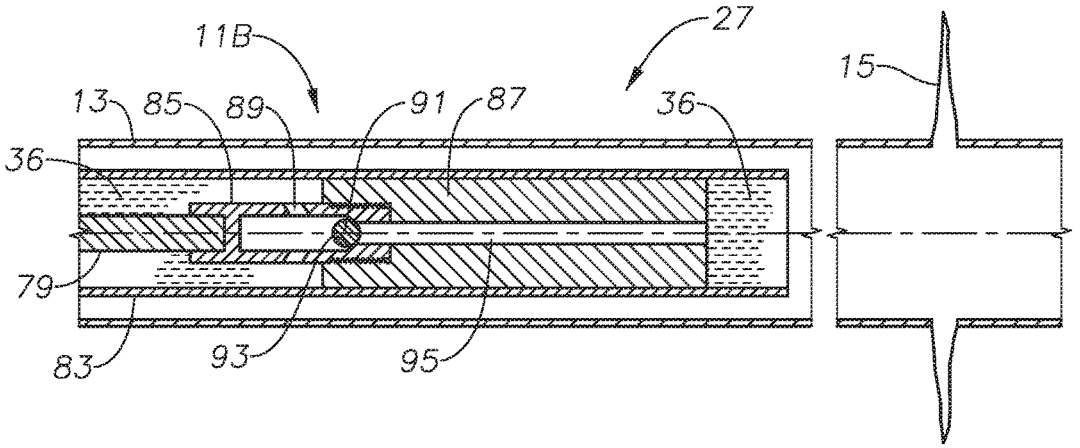

Referring to FIG. 3A, the lower ends of working fluid conduit 61, upstroke conduit 57, and outer tubing 55 secure to a lower hanger 71, which is part of lower lifting unit 27. Lower hanger 71 is similar to upper hanger 51 (FIG. 2B) but inverted. Lower hanger 71 has a longitudinal axis 72 and ports 73 that lead from outer annulus 59 to below lower hanger 71. Working fluid conduit 61 has lower ports 75 that communicate the lower end of inner annulus 63 with the interior of working fluid conduit 61 below a lower piston 77 in working fluid conduit 61. A downstroke working fluid 78 is located in working fluid conduit 61, filling the sealed space between upper piston 49 (FIG. 2B) and lower piston 77. Lower communication ports 75 are located below lower piston 77 while lower piston 77 is in both its lower and upper positions.

In this example, downstroke working fluid 78 is sealed from upstroke working fluid 69 (FIG. 4) by upper and lower pistons 49, 77. Because of sealing at the upper and lower pistons 49, 77 in this embodiment, the downstroke fluid 78 is trapped, and the length of the column of downstroke fluid 78 is constant. Thus the distance between upper piston 49 and lower piston 77 remains constant. Also, in this embodiment, inner annulus 63 and the interior of working fluid conduit 61 are sealed from outer annulus 59. Thus upstroke working fluid 69 and downstroke working fluid 78 are sealed from well fluid 36 as well as from each other. Working fluids 69 and 78 may be the same and may be different fluids from well fluid 36, which flows though outer annulus 59. In this embodiment, working fluids 69 and 78 are substantially incompressible liquids. The interior of working fluid conduit 61, inner annulus 63 and upper and lower pistons 49, 77 define a closed loop hydraulic system wherein stroking movement of upper piston 49 causes lower piston 77 to stroke in unison.

Lower piston 77 may be constructed the same as upper piston 49 (FIG. 2B) and slidingly and sealingly engages the inner diameter of working fluid conduit 61 above inner tubing lower ports 75 while in the lower and upper positions. A lower connecting rod 79 secures to the lower end of lower piston 77 and extends sealingly through a bore 81 of lower hanger 71. Lower connecting rod 79 moves in unison with lower piston 77 and may be only a few feet in length.

A lower pump housing 83 secures to and extends downward from lower hanger 71. Lower pump housing 83 may have the same diameter as upper pump housing 28 (FIG. 2A), and its interior is in fluid communication with well fluid 36 flowing from perforations 15. Lower pump housing 83 may be considered to be a lower end of the lower section of production tubing 17 (FIG. 1). In this example, lower pump housing 83 has a same outer diameter as upper pump housing 28 (FIGS. 2A and 2B). A check valve (not shown) could be mounted at the lower end of lower pump housing 83 to allow inflow of well fluid 36 in lower pump housing 83 but block outflow toward perforations 15. A coupling 85 connects the lower end of lower connecting rod 79 to a lower plunger 87. Lower plunger 87 strokes sealingly within a polished bore section of lower pump housing 83 and may be the same construction as upper plunger 29 (FIG. 2A). Coupling 85 is hollow and has ports 89 in fluid communication with well fluid 36 in lower pump housing 83. A lower ball 91 engages a lower ball seat 93 formed in coupling 85. Ball seat 93 is in fluid communication with well fluid 36 within an axial passage 95 in lower plunger 87.

During installation, an operator will downstroke working fluid 78 into working fluid conduit 61 between upper piston 49 and lower piston 77. The operator fills upstroke working fluid 69 into working fluid conduit 61 above upper piston 49 and below lower piston 77. The operator fills upstroke working fluid 69 into inner annulus 63. The operator lowers the entire assembly into casing 13 to a position placing lower lifting unit 27 in lower well section 11B and upper lifting unit 21 in upper well section 11A.

In operation, rod lifting mechanism 25 (FIG. 1) will lift rod string 23, and allow rod string 23 to lower by gravity. When rod lifting mechanism 25 causes rod string 23 to move downward by gravity, upper plunger 29 and upper piston 49 move downward in unison. The downward movement of upper piston 29 hydraulically acts on lower piston 77 (FIG. 3A) because of the incompressible column of downstroke working fluid 78 in working fluid conduit 61 between upper piston 49 and lower piston 77. The downward movement of upper piston 29 thus exerts a downward hydraulic force on lower piston 77, pushing it closer to well perforations 15. Lower plunger 87 moves in unison with lower piston 77.

The same downward movement of rod string 23 (FIG. 2A) causes well fluid 36 in lower pump housing 83 below lower plunger 87 to flow into lower lifting unit passage 95 (FIG. 3B), past valve ball 91 and into the interior of lower pump housing 83. Well fluid 36 flows through lower hanger ports 73 into outer annulus 59 (FIG. 3A), and from outer annulus 59 through upper hanger ports 65 (FIG. 2B) into the interior of upper pump housing 28. During the downstroke, well fluid 36 flows through coupling ports 47 and upper ball seat 37 into upper pump housing 28 above upper plunger 29.

During the downstroke, upstroke working fluid 69 being displaced in working fluid conduit 61 below lower piston 77 by the downward movement of lower piston 77 flows out of working fluid conduit 61 through lower communication ports 75 into inner annulus 63. Upstroke working fluid 69 in inner annulus 63 flows through upper communication ports 67 (FIG. 2B) into the interior of working fluid conduit 61 above upper piston 49.

When rod lifting mechanism 25 begins lifting rod string 23, upper plunger 29 moves upward in unison, lifting well fluid 36 above it in upper pump housing 28 through production tubing 17, wellhead 19 (FIG. 1), and out into a flow line. Upper piston 49 moves upward with upper plunger 29, expelling upstroke working fluid 69 out upper communication ports 67 down inner annulus 63 (FIG. 2B). The upward movement of upper piston 49 increases the pressure of upstroke working fluid 69 in inner annulus 63, forcing upstroke working fluid 69 through lower communication ports 75 (FIG. 3A) on the lower side of lower piston 77. Lower piston 77 moves upward in response and in unison with upper piston 49, bringing lower plunger 87 along with it.

Because lower ball 91 closes lower seat 93, lower plunger 87 pushes well fluid 36 above it in lower pump housing 83 through lower hanger ports 73 (FIG. 3A) into outer annulus 59. The increase in pressure of well fluid 36 in outer annulus 59 forces well fluid 36 out upper hanger ports 65 (FIG. 2B) into upper pump housing 28 to fill the increasing volume that occurs in upper pump housing 28 below upper plunger 29 as upper plunger 29 moves upward. Upper plunger 29 lifts well fluid 36 in upper pump housing 28 above it through production tubing 17 to wellhead 19 during the upstroke.

Modifications may be made. For example, instead of using a separate piston and plunger in each pump assembly, a single combined piston or plunger could be used. The combined plunger in the vertical section can provide a working fluid to the plunger in the horizontal section. This arrangement would allow the plunger in the horizontal section to produce the well fluid to the wellhead. Gravity of the well fluid would push the plunger in the horizontal section back down. The working fluid and the well fluid could be the same.

In another variation, both the plungers can have a central flow passage for well fluid and a different valve arrangement than shown. Another alternative would be to pneumatically stroke the lower lifting unit in response to upward movement of the upper lifting unit, rather than hydraulically.

In another alternative, the plunger in the vertical section could be connected to the plunger in the horizontal section by a mechanical means, such as by a cables. One cable could pull the lower lifting unit up on the upstroke and another cable pull the lower lifting unit down on the downstroke. The cables could be run through a pipe with or without cable guides or linear bearings. Alternately, a flexible mechanical linkage that accommodated tension and compression could connect the upper and lower lifting units. The cables employed to clean out sewer pipes are examples of a flexible mechanical linkage that accommodates both tension and compression. This type of mechanical linkage could be placed in the center of a tube lined with linear guide bearings to reduce friction and provide support so that it does not buckle under compressive loads.

Further, rather than concentric inner tubing, intermediate tubing, and outer tubing, the tubing sections between the upper and lower subassemblies could be side-by-side and parallel.

The invention claimed is:

1. A well pump assembly for pumping well fluid from a well having an upper vertical section and a lower inclined section, comprising:

an upper lifting unit having an upper plunger configured for upward and downward movement within the upper vertical section of the well;

a coupling on an upper end of the upper plunger for connection to a string of sucker rods in the vertical section of the well to move the upper plunger upward and downward;

a lower lifting unit having a lower plunger configured for upward and downward movement within the lower inclined section of the well to pump well fluid up the well;

linking means configured to extend from the vertical section of the well to the inclined section of the well for causing the lower plunger to move upward in unison with the upper plunger, and to move downward in unison with the downward movement of the upper plunger; wherein the linking means comprises:

a working fluid conduit extending between the upper and the lower lifting units;

an upper piston in the working fluid conduit connected with the upper plunger for upward and downward movement in unison;

a lower piston in the working fluid conduit connected with the lower plunger, the lower plunger being movable in unison with the lower piston;

a downstroke working fluid in the working fluid conduit between the upper and lower pistons; and wherein downward movement of the upper piston transmits a downward force through the downstroke working fluid to the lower piston, causing the lower piston to move downward.

2. The assembly according to claim 1, wherein:

the downstroke working fluid is trapped in the working fluid conduit between the upper piston and the lower piston, defining a fixed distance between the upper piston and the lower piston, the downstroke working fluid being sealed from the well fluid in the well.

3. The assembly according to claim 1, further comprising:

an upstroke conduit extending between the upper and lower lifting units and containing an upstroke working fluid;

an upper portion of the upstroke working fluid being above the upper piston for applying pressure to the upstroke working fluid while the upper piston is moving upward; and a lower portion of the upstroke working fluid being below the lower piston and in fluid communication with the upper portion of the upstroke working fluid via the upstroke conduit, such that the upward movement of the upper piston applies a pressure to the lower portion of the upstroke working fluid to move the lower piston upward in response.

4. The assembly according to claim 3, wherein:

the upstroke conduit is sealed from well fluid in the vertical and inclined sections of the well.

5. The assembly according to claim 3, wherein the upstroke working fluid is sealed from the downstroke working fluid by the upper piston and by the lower piston.

6. The assembly according to claim 3, wherein:

the upstroke conduit surrounds the working fluid conduit, defining an inner annulus between the upstroke conduit and the working fluid conduit; and the linking means further comprises:

an upper communication port extending from the upstroke conduit into the working fluid conduit above the upper piston;

a lower communication port extending from the upstroke conduit into the working fluid conduit below the lower piston; and wherein the upstroke working fluid is in the inner annulus, in the working fluid conduit above the upper piston, and in the working fluid conduit below the lower piston.

7. The assembly according to claim 6, further comprising:

a section of production tubing extending between the upper and lower lifting units and surrounding the upstroke conduit, defining an outer annulus; and the outer annulus communicates well fluid being pumped upward by the lower plunger to the upper lifting unit.

8. A well pump assembly, comprising:

an upper lifting unit having an upper plunger configured to be located within an upper section of the well and to move upward and downward;

a coupling on an upper end of the upper plunger for connecting the upper plunger to a string of sucker rods extending down the upper section of the well for moving the upper plunger upward and downward;

a lower lifting unit having a lower plunger configured to move upward and downward in unison with the upper plunger and within a lower section of the well that is inclined relative to the upper section of the well and below the upper lifting unit for pumping well fluid up the well;

a working fluid conduit between the upper and lower lifting units, the working fluid conduit having a lower section that is inclined relative to an upper section of the working fluid conduit;

an upper piston in the upper section of the working fluid conduit and connected with the upper plunger for upward and downward movement therewith;

a lower piston in the lower section of the working fluid conduit and connected with the lower plunger, the lower plunger being movable in unison with the lower piston;

a downstroke working fluid filled between the upper and lower pistons in the working fluid conduit, wherein downward movement of the upper piston exerts a downward force on the working fluid, causing the lower piston to move downward in unison with the upper piston;

an upstroke conduit, the upstroke conduit having a lower section that is inclined relative to an upper section of the upstroke conduit;

an upper port in the working fluid conduit above the upper piston in fluid communication with the upstroke conduit, and a lower port in the working fluid conduit below the lower piston in fluid communication with the upstroke conduit; and an upstroke working fluid filling the upstroke conduit and the working fluid conduit above the upper piston and below the lower piston, wherein upward movement of the upper piston exerts an upward force on the upstroke working fluid above the upper piston, which transmits via the upstroke conduit to the upstroke working fluid below the lower piston, creating an upward force on the lower piston, causing the lower piston to move upward in unison with the upper piston.

9. The assembly according to claim 8, wherein:

the upstroke conduit surrounds the working fluid conduit, defining an inner annulus containing the upstroke working fluid.

10. The assembly according to claim 8, further comprising:

a lower section of production tubing extending between the lower lifting unit and the upper lifting unit for flowing well fluid from the lower lifting unit to the upper lifting unit, the lower section of production tubing enclosing the working fluid conduit and the upstroke conduit.

11. The assembly according to claim 8, further comprising:

a lower section of production tubing extending between the lower lifting unit and the upper lifting unit; wherein the upstroke conduit surrounds the working fluid conduit, defining an inner annulus containing the upstroke working fluid; and the lower section of the production tubing surrounds the upstroke conduit, defining an outer annulus through which well fluid pumped by the lower plunger flows.

12. The assembly according to claim 8, wherein:

the downstroke working fluid is sealed from the upstroke working fluid by the upper and lower pistons; and the downstroke working fluid and the upstroke working fluid are sealed from the well fluid by the lower piston and the upstroke conduit.

13. A method of pumping well fluid from a well having a vertical upper section and an inclined lower section, comprising:

(a) connecting a linking arrangement between a lower lifting unit having a lower plunger and an upper lifting unit having an upper plunger;

(b) positioning in the inclined lower section of the well the lower lifting unit and positioning in the vertical upper section of the well the upper lifting unit, and connecting the upper lifting unit to a string of sucker rods;

(c) with the string of sucker rods, stroking the upper plunger upward, and with the linking arrangement, causing the lower plunger to move upward in unison with the upper plunger and causing the lower plunger to lift well fluid located above the lower plunger; and (d) with the string of sucker rods, stroking the upper plunger downward, the linking arrangement causing the lower plunger to move downward in unison with the upper plunger.

14. The method according to claim 13, wherein step (a) comprises:

placing a working fluid conduit between the upper and the lower lifting units;

placing an upper piston in the working fluid conduit and connecting the upper piston to the upper plunger for upward and downward movement in unison;

placing a lower piston in the working fluid conduit and connecting the lower piston with the lower plunger for upward and downward movement in unison with the lower piston;

filling the working fluid conduit between the upper and lower pistons with a downstroke working fluid; and wherein step (d) comprises:

transmitting a downward force from downward movement of the upper piston through the downstroke working fluid to the lower piston, causing the lower piston to move downward in unison.

15. The method according to claim 13, wherein step (a) comprises:

connecting a working fluid conduit between the upper and the lower lifting units;

placing an upper piston in the working fluid conduit and connecting the upper piston to the upper plunger for upward and downward movement in unison;

placing a lower piston in the working fluid conduit and connecting the lower piston with the lower plunger for upward and downward movement in unison with the lower piston;

filling the working fluid conduit between the upper and lower pistons with a downstroke working fluid;

connecting an upstroke conduit between the upper and lower lifting units;

filling the upstroke conduit and a portion of the working fluid conduit above the upper piston and a portion of the working fluid conduit below the lower piston with an upstroke working fluid; wherein step (c) comprises applying an upward force to the upstroke working fluid above the upper piston and via the upstroke conduit to the upstroke working fluid below the lower piston while the upper piston is moving upward, thereby causing the lower piston to move upward in unison; and step (d) comprises:

transmitting a downward force from downward movement of the upper piston through the downstroke working fluid to the lower piston, causing the lower piston to move downward in unison.

16. The method according to claim 15, further comprising:

sealing the upstroke working fluid and the downstroke working fluid from each other; and sealing the upstroke working fluid and the downstroke working fluid from the well fluid.

17. The method according to claim 13, wherein step (b) further comprises:

connecting the string of sucker rods to a pump jack at an upper end of the well; and step (c) comprises:

with the pump jack, stroking the string of sucker rods upward.

* * * * *